United States Patent [19]

Nakanishi

[11] 4,436,571

[45] Mar. 13, 1984

[54] PRINTING APPARATUS

[75] Inventor: Motoyasu Nakanishi, Fujishi, Japan

[73] Assignee: Kabushiki Kaisha Cubic Engineering, Shizuokaken, Japan

[21] Appl. No.: 401,983

[22] Filed: Jul. 26, 1982

[30] Foreign Application Priority Data

Aug. 18, 1981 [JP] Japan ..... 56-129878

[51] Int. Cl.[3] ..... B44C 1/16

[52] U.S. Cl. ..... 156/384; 156/230; 156/236; 156/540; 156/584

[58] Field of Search ..... 156/230, 235, 236, 246, 156/541, 542, 584, 384, 540

[56] References Cited

U.S. PATENT DOCUMENTS

| | | | |
|---|---|---|---|
| 4,010,057 | 3/1977 | Nakanishi | 156/230 X |
| 4,229,239 | 10/1980 | Arai et al. | 156/230 X |
| 4,348,246 | 9/1982 | Nakanishi | 156/236 X |

*Primary Examiner*—David A. Simmons

*Attorney, Agent, or Firm*—Wenderoth, Lind & Ponack

[57] ABSTRACT

A printing apparatus provided with a structure which supplies a transcription film into a transcription tub containing a liquid so that the transcription film is kept afloat on the liquid, a structure which makes the liquid flow in a direction in which the film is supplied, and a structure which slantingly immerses an article to be printed into the liquid in the transcription tub from an upstream position to a downstream position of the liquid. The transcription tub is provided with a structure which blows pressurized air onto the transcription film to eliminate wrinkles of the film. The film supplying structure of the printing apparatus is equipped with a feed roller mechanism provided with a cutter for cutting slits in both side end parts of the film. In the transcription tub of the printing apparatus is provided a set of belt-type guide members which support both side edges of the film and feed the film along the liquid flow. This printing apparatus is equipped with a film removing device which removes the film waste adhering to the article to be printed by a shower.

16 Claims, 7 Drawing Figures

PRINTING APPARATUS

BACKGROUND OF THE INVENTION

The present invention relates to a printing apparatus which transcribes a desired pattern onto an article to be printed by utilizing a liquid. This type of the printing apparatus is known as shown in the specification of the U.S. Pat. No. 4,010,057.

However, in case of the printing apparatus according to the U.S. patent, wrinkles are often formed on the film when it is expanded. Therefore this printing apparatus is disadvantageous in that an irregularity is caused on a pattern transcribed onto the article to be printed upon and in that the film should be replaced at the time of every transcription since the article to be printed upon is turned in the liquid while it is kept in contact with the film which is kept stationary, and accordingly, the number of transcription printing operations within a unit of time is limited.

An object of the present invention is to provide a printing apparatus which is adapted to carry out continuous transcriptions of a pattern onto articles to be printed upon by causing the liquid to flow at a fixed rate in the film supplying direction in the transcription tub and making the article to be printed upon contact the film in a slanted direction.

Another object of the present invention is to provide a printing apparatus in which the feed roller mechanism which supplies the film in the transcription tub is provided with cutters and both side edges of the film are notched in sequence to eliminate wrinkles in the film.

A further object of the present invention is to provide a printing apparatus in which a set of belt type guide members which support both side edges of the film is provided in the transcription tub and the movement of the film is accurately controlled by moving the set of guide members in accordance with the flow rate of the liquid.

Still further object of the present invention is to provide a printing apparatus in which a shower is employed as a means to remove the film from the transcribed article after transcription and to thus wash off the film.

Another object of the present invention is to provide a printing apparatus in which a blowing means which blows pressurized air onto the film surface is provided in the transcription tub to eliminate wrinkles in the film.

SUMMARY OF THE INVENTION

The apparatus according to the present invention comprises a transcription tub which is open at its upper side and contains a liquid such as, for example, water, a film supplying means which continuously supplies a film for transcription printing into said transcription tub, a liquid flowing means such as, for example, a circulatory tube system which permits flowing of the liquid at a fixed flow rate in the film supplying direction, that is, in a direction from the position where said film supplying means is located to the opposite side, and an object supplying mechanism which is provided above said transcription tub, wherein said film supplying means is adapted to feed an expandable film for transcription on which a transcription pattern is printed onto the liquid surface so that the transcription pattern of the film is faced up and said article supplying mechanism is adapted to slantingly immerse all or part of the article to be printed upon into the liquid in a direction from the upstream to the downstream of the liquid while keeping said article in contact with the film which is kept afloat on the liquid in said transcription tub and to lift up said article slantingly from the liquid after changing over the direction of movement of the article in the liquid.

In said transcription tub, a blowing means which is adapted to eliminate wrinkles in the transcription film with pressurized air blown onto the film surface from the upper side is provided at a more upstream position than the position where said article to be printed upon comes in contact with the film.

Said film supplying means is provided with a feed roller mechanism which feeds and supplies a long continuous film on the liquid in the transcription tub, and this feed roller mechansim is provided with a set of feed rollers which contact the film with a pressure from upper and lower sides and a plurality of cutters which are arranged at both end parts of the rollers or separately from the rollers and is adapted to notch in sequence both side edges of the film by said cutters in the course of feeding said film.

A set of belt type guide members which respectively support both side edges of said film are arranged to oppose each other inside the transcription tub and are adapted to move while supporting the film at the same rate as the flow rate of said liquid from the upstream side to the downstream side.

A film removing device is provided following said transcription tub wherein the carrying belt of said article supplying mechanism is extended into said film removing device through above said transcription tub and is adapted to remove the film remaining on the article to be printed by means of a shower.

BRIEF DESCRIPTION OF THE DRAWINGS

In order that the invention may be more fully understood, preferred embodiments are now described with reference to the accompanying drawings, in which.

DETAILED DESCRIPTION OF THE PREFERRED EMBODIMENTS

Figure 1:
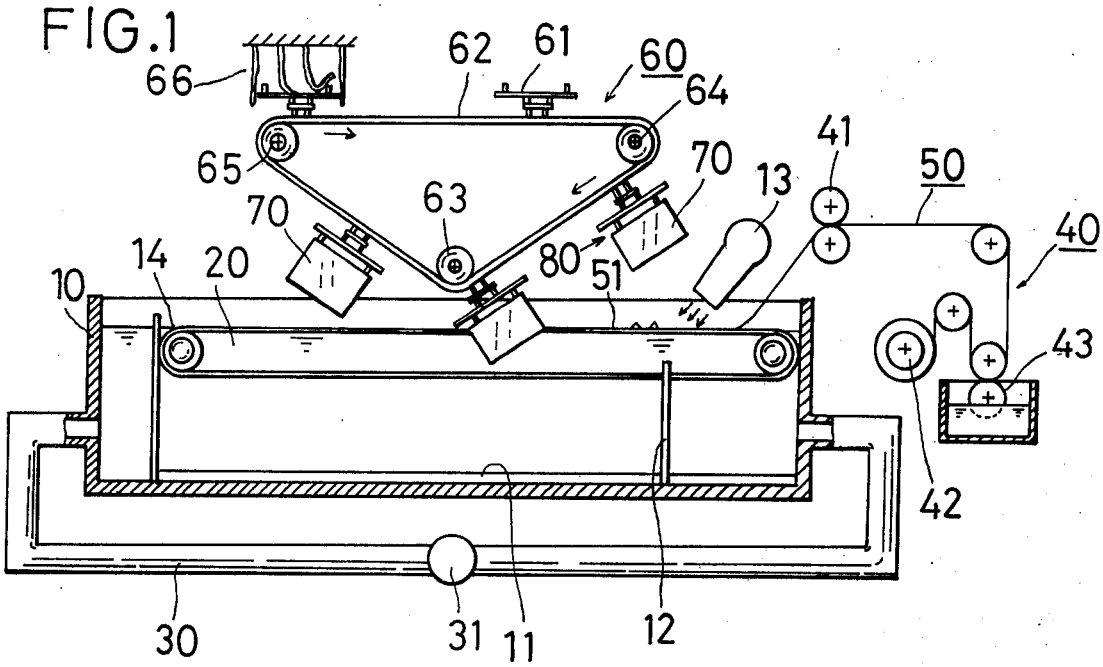
FIG. 1 is a cross-sectional side view of principal components showing the construction of the printing apparatus according to the present invention.
Figure 2:
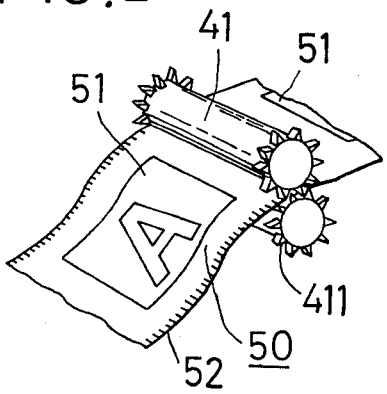
FIG. 2 is a rough perspective view of an embodiment of the feed roller mechanism of said apparatus.

The following describes the printing apparatus of the present invention referring to the accompanying drawings. In FIG. 1, there is shown a transcription tub 10 which contains a liquid such as, for example, water 20. Said transcription tub 10 is provided with the heater 11 at the bottom to maintain water 20 at the specified temperature and is constructed to circulate water 20 in the transcription tub by a circulation piping system 30 provided with a pump 31 and the liquid level is forced to flow in a fixed direction, for example, in a direction from the right side to the left side in the figure. For the purpose of maintaining a uniform liquid level, a flow control means such as, for example, flow control plate 12 is arranged in the transcription tub to smooth the liquid level.

A film supplying part 40 is arranged at the upstream side of said transcription tub 10 and comprises a film feeding means such as, for example, a feed roller mechanism 41, the film holding part which feeds film 50 to said feed roller mechanism 41 such as, for example, the film holding frame 42 which supports the film 50 which is wound in the form of a roll and the film activating means such as, for example, the roll coater 43 provided between said film holding frame 42 and said feed roller mechanism 41, and said roll coater 43 activates the printing ink on the transcription pattern 51 printed on the film 50.

For activating the printing ink, an ink solvent can be applied onto the transcription pattern. In the embodiment, an activating solvent is applied onto the transcription pattern 51 by the roll coater 43, alternatively, the activating solvent can be sprayed onto the transcription pattern as the case requires.

Said film 50 is made as a long film by using a material which expands when it comes in contact with a liquid in the transcription tub 10, such as, for example, polyvinyl alcohol in the event the transcription tub 10 contains water as shown in the embodiment, and the transcription pattern 51 is printed in sequence on one side of the film 50 and the film 50 is wound in the form of roll.

Said transportation film 50 is intermittently or continuously fed with its printed side of the transcription pattern 51 face up by said feed roller mechanism 41 into the transcription tub 10, and the film 50 is moved to the downstream side along the liquid surface while being kept afloat on the liquid and is expanded while absorbing the liquid.

Since the film would otherwise often become entirely wrinkled or curled at its side edges in the initial stage of expansion of the film in some cases, an air blower 13 is therefore provided above the transcription tube 10 to avoid such wrinkles and curling.

Said air blower 13 is adapted to apply a wind pressure onto the surface of the film 50 in a slanted direction from the upstream side to the downstream side of movement of the film, thus preventing the film 50 from becoming entirely wrinkled, or curled at the side edges.

Said feed roller mechanism 41 is provided with cutters 411 on both ends of the roll to cut notches at both side edges of the film 50 and these notches serve to eliminate curling of both side edges of the film 50. This cutter mechanism can be provided separately from said feed roller mechanism. In that case, however, the cutter mechanism is preferably arranged at the feed-out side of the feed roller mechanism 41.

In other words, since the expansion rate at the side with the transcription pattern 51 of said film 50 is lower than that at other parts of the film 50 due to the effect of the activating agent applied to the transcription pattern 51 side, said curling takes place at both side edges of the film and another kind of curling resulting from stress in making the film 50 itself is caused. For this reason, it is necessary to eliminate such curling.

Said film 50 is expanded in the widthwise and lengthwise directions in the transcription tub 10. In this case, the expansion in the lengthwise direction is absorbed by the movement of the film but the expansion in the widthwise direction continues until the film comes in contact with the internal wall of the transcription tube 10.

If the side edges of the transcription film 50 come in contact with the internal walls of the transcription tub 10, the side edges of the film adhere to the internal walls of the transcription tub 10 and the rate of movement of the middle part of the film differs from that of the side edge parts of the film and the transcription pattern 51 of the film 50 is deformed, thus damaging the effectiveness of the transcription on the article to the printed upon.

Figure 3:
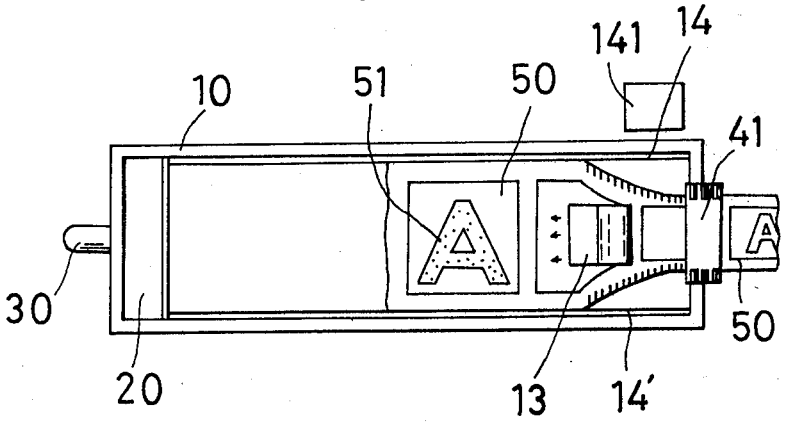
FIG. 3 is a plan view of the transcription tub of said apparatus.

Therefore, in the transcription tub 10, belt type guide members 14 and 14' such as, for example, chains or guide rubber belts are provided at opposite sides to support both side edges of the film 50 as shown in FIG. 1 and FIG. 3. A set of these guide members 14 and 14' is constructed so that the guide members are moved in conformity with the film supplying rate, that is, the film feeding rate. These belt type guide members 14 and 14' are moved by a driving means such as the drive motor 141 or the like.

Thus, both side edges of the film 50 are moved by the guides 14 and 14' and both side edges and the middle part of the film 50 are moved at the same speed and the transcription pattern 51 is prevented from being deformed.

An article supplying mechanism 60 is provided above the transcription tub 10 so that it is located at the downstream side away from said air blower 13, and so that the object 70 to be printed upon is immersed in the liquid and lifted up from the liquid in the transcription tub 10 by the article supplying mechanism 60.

Said article supplying mechanism 60 is adapted to slantly move down successive articles 70 to be printed upon from the upstream side to the downstream side of the film 50, to make the article 70 contact the transcription pattern 51 of the film 50, to immerse all or part of the article 70 to be printed upon into the liquid while keeping the articles 70 in contact with transcription pattern 51, and to upwardly move the articles 70 from the upstream side toward the downstream side after being pivoted upward within the liquid, to lift up the article 70 printed from the transcription tub 10. In the embodiment, the article supplying mechanism 60 is provided with holding means for freely mounting and demounting the articles 70 to be printed upon such as, for example, holding members 61 which mount, demount and hold jigs 80 which are previously attached to the articles 70, an endless carrying belt 62 such as, for example, an endless chain or endless belt to which said holding members 61 are fixed at specified intervals, and three pulleys 63, 64 and 65 on which said endless carrying belt 62 is applied in the form of a reversed triangle with the peak of the triangle located close to the liquid level in the transcription tub 10.

Said article supplying mechanism 60 is constructed so that before immersion in the liquid 20, article 70 is initially mounted between the center pulley 63 and the right-side pulley 64 in the figure and later demounted between the center pulley 63 and the left-side pulley 65 and the demounted article 70 is then moved to the film removing process. Moreover a cleaning means such as, for example, wiping cloth 66 is arranged to clean holding members 61 between said pulley 65 and pulley 64.

A holding member 61 comes in contact with an article 70 to be printed upon and the film 50 at the same time and is therefore tainted with film waste and the printing ink of the transcription pattern 51. Said cleaner such as, for example, wiping cloth 66 serves to keep the article 70 to be next printed clean from the film waste and printing ink.

By constructing said article supplying mechanism 60 so that the article 70 to be printed upon is forced to contact the film 50 in a slanted direction, pivoted in the liquid in the transcription tub 10 and lifted up slantingly, the film 50 can be advantageously closely adhered to the article 70 to be printed as if the article 70 picks up the film 50, and bubbles which may remain between the film 50 and the article 70 to be printed upon can be effectively prevented from emergence. The angle of the article 70 in its approach to the film 50 should preferably be varied in accordance with the shape and size of the article 70 to be printed upon.

Figure 4:
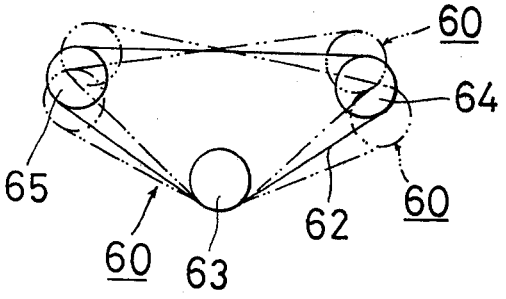
FIG. 4 is a rough side view of the article supplying mechanism of said apparatus.
Figure 5:
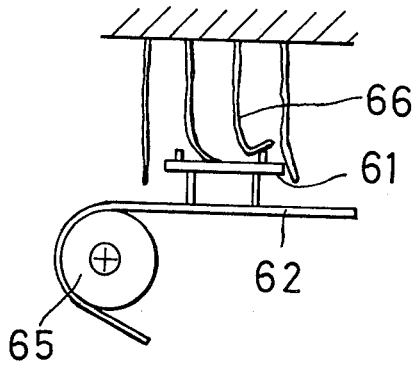
FIG. 5 is a rough side view of the cleaning means provided on said article supplying mechanism.

In the embodiment, therefore, said pulleys 64 and 65 are arranged pivotably to the broken-line position and the dotted-line position as shown in FIG. 4 so that the angle at which the article 70 to be printed upon is feed in against the film 50 can be adjusted.

In said embodiment, when the article 70 to be printed is removed from the article supplying mechanism 60 it is moved to the film removing process. In this arrangement, manpower is required for moving the article 70 to the film removing process.

Figure 6:
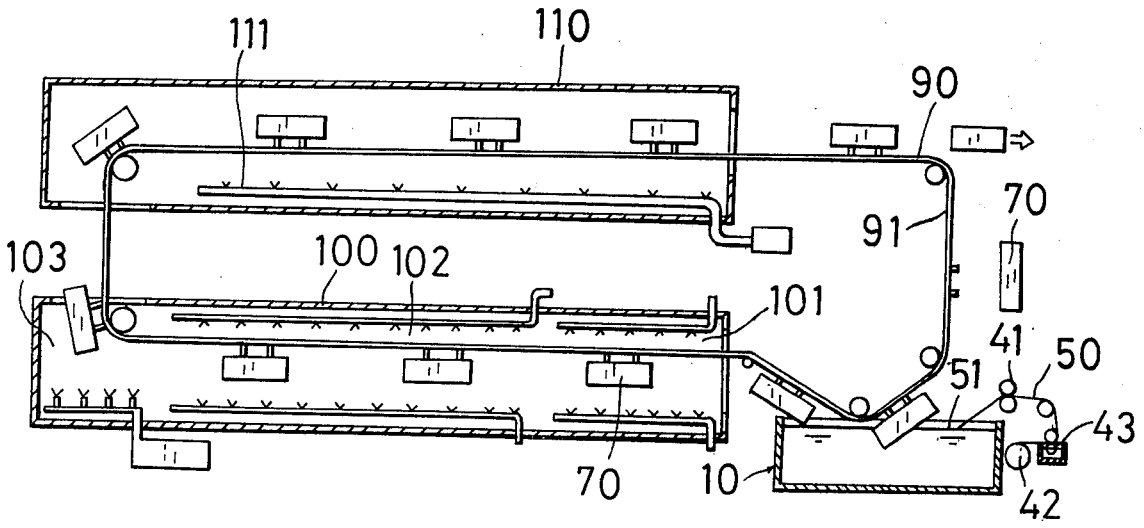
FIG. 6 is a cross-sectional side view of principal components showing another embodiment of the printing apparatus according to the present invention.

The embodiment shown in FIG. 6 can solve this kind of problem. In this embodiment, an endless carrying belt 91 of an article supplying mechanism 90 is constructed so that the endless carrying belt is circulated through a film removing device 100 and a drying device 110.

Said film removing device 100 incorporates a film dissolving shower 101 which dissolves and removes the film 50, a cleansing shower 102 provided following said film dissolving shower 101, and an air blower 103 for removing water provided next to said cleansing shower 102. When the film 50 made of polyvinyl alcohol is used in the transcription tub 10 containing water as shown, in this embodiment, the hot water shower can be used as the film dissolving shower 101 and a cold air blower for blowing off water remaining on the article 70 which has now been printed upon can be employed as the air blower 103.

Said drying device 110 can be an infrared ray heater which heats to dry the article 70 printed. In the embodiment, the hot air blowing pipe system 111 which blows hot air to the printed upon article 70 is employed.

In the embodiment shown in FIG. 6, said blowing pipe system 111 having a single pipe is given. In this case, the article 70 is turned upside down and the jig 80 and the endless carrying belt 91 are cleaned to be free from film waste; therefore it is actually desired to provide a plurality of pipes as the blowing pipe system 111 at the upper and lower sides.

Figure 7:
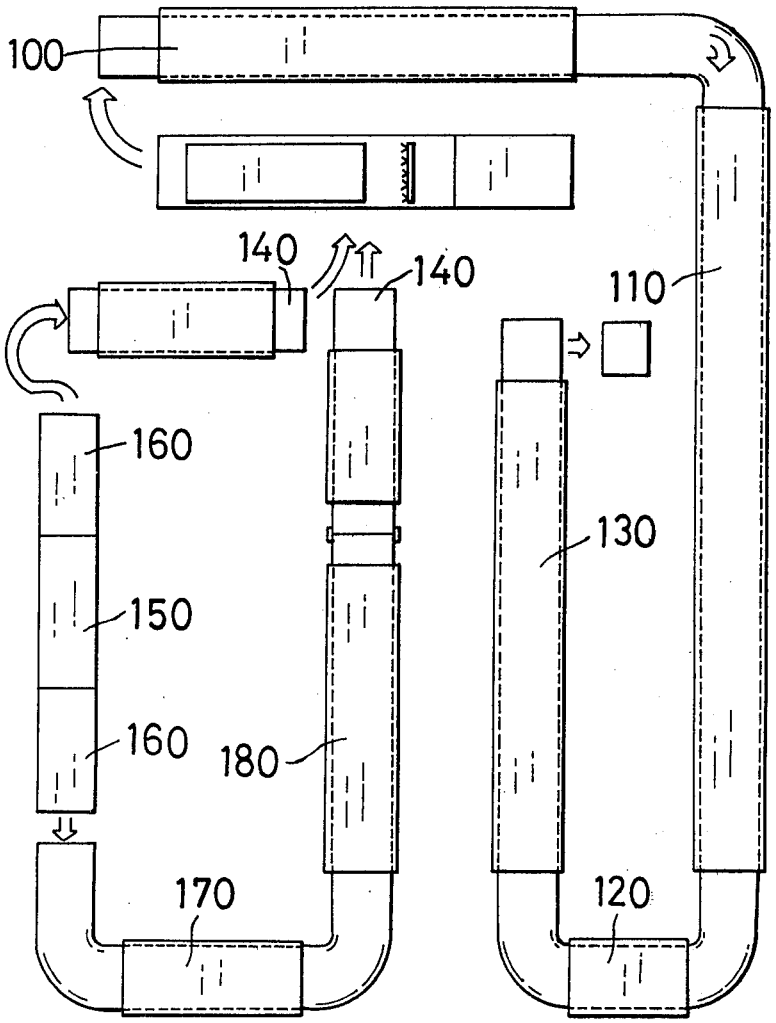
FIG. 7 is a rough plan view of another embodiment of the apparatus according to the present invention.

The following describes the embodiment shown in FIG. 7. In this embodiment, said film removing device 100 and the drying device 110 are continuously provided in the same plane and the drying device 110 is equipped with a top coat applying device 120 and a top coat drying device 130 such as, for example, a far infrared ray type drying oven, which are adjacently located, whereby each article 70 for which drying treatment has been finished is covered with a top coat as desired by the top coat applying device 120 and is taken out after having been dried by the top coat drying device 130.

Said article 70 is generally conveyed to the transcription tub 10 after having been electrostatically neutralized. In other words, the article 70 to be printed collects dust unavoidably due to an electrostatic effect of a synthetic resin material of which the article 70 is made and therefore it may be required to remove such dust from the article 70 by electrostatic neutralization before transcription printing.

Said article 70 undergoes a pretreatment such as a degreasing treatment prior to said electrostatic neutralization and, at the same time, said jig is attached to the article 70 by a jig attaching part 160.

If a primer coating is required as a base coating on the article 70 to be printed, a primer coating device 170 is provided between the jig attaching part 160 and an electrostatic neutralizing device 140, and a drying device 180 such as, for example, a far infrared ray drying oven, is provided for drying the primer coating; thus the article 70 to be printed is primer-coated before electrostatic neutralization.

As described above, the printing apparatus of the present invention is adapted to make the article 70 to be printed upon contact with the film 50 in the slanted direction after the film 50 has been smoothed by the air blowing part 13, immerse the article 70 into the liquid, and turn the article 70 to be printed in the liquid to make the film 50 closely adhere to the article 70. Accordingly, said printing apparatus is advantageous in that the formation of wrinkles on the transcription pattern 51 of the film 50 can be effectively prevented, the liquid pressure borne by the article 70 can be gradually conducted from the lower end of the article 70 to the top, bubbles can be effectively prevented from remaining between the article 70 to be printed upon and the film 50 and the transcription pattern 51 can be finely transcribed and printed on the article 70.

The printing apparatus of the present invention is adapted so that the article 70 to be printed upon is lowered slantingly from the upstream side to the downstream side and is therefore advantageous in that the article 70 to be printed upon can be aligned with the film 50 under movement and a plurality of articles 70 can be continuously fed in sequence into the transcription tub 10 while continuously feeding the film 50 onto the liquid and thus a great number of articles 70 can be continuously handled for transcription printing.

What is claimed is:

1. A printing apparatus comprising (a) a transcription tub for containing a liquid, which is open at its upper side, (b) a means for directing a flow of the liquid through said transcription tub at a fixed rate, (c) a film supplying means, provided at an upstream side of said transcription tub relative to the flow direction of the liquid through said transcription tub, for supplying a long transcription film onto the surface of the liquid so that a transcription pattern on the film is kept face up, and (d) an article supplying means, provided above said transcription tub, for immersing at least part of an article to be printed upon into the liquid while keeping the article in contact with the transcription pattern of the film, wherein said article supplying means includes means for directing the article to be printed upon from above said transcription tub downward and downstream into downward and downstream slanting contact with the film and transcription pattern thereon in said transcription tub, changing the direction of movement of the article within the liquid and transferring the transcription pattern onto the article and lifting the article slantingly upward and downstream to move the article and transcription pattern out of the transcription tub.

2. A printing apparatus in accordance with claim 1, wherein said article supplying means comprises three triangularly disposed pulleys, and endless carrying belt surrounding said pulleys so as to be drivable thereby, and at least one holding member provided on said carrying belt for removably holding the article to be printed upon thereto.

3. A printing apparatus in accordance with claim 2, further comprising a cleaner for scrubbing said holding member when said carrying belt moves, disposed adjacent said carrying belt.

4. A printing apparatus in accordance with claim 1, further comprising a heater disposed at the bottom of said transcription tub.

5. A printing apparatus comprising (a) a transcription tub for containing a liquid, which is open at its upper side, (b) a means for directing a flow of the liquid through said transcription tub at a fixed rate, (c) a film supplying means, provided at an upstream side of said transcription tub relative to the flow direction of the liquid through said transcription tub, for supplying a long transcription film onto the surface of the liquid so that the film floats on the surface of the liquid with a transcription pattern on the film kept face up, (d) an article supplying means, provided above said transcription tub, for immersing at least part of an article to be printed upon into the liquid while keeping the article in contact with the transcription pattern of the film, and for lifting up the article to be printed upon from the liquid, and (e) a blowing means, located between said film supplying means and said article supplying means, for blowing pressurized air in a downstream direction onto the film flowing on the liquid in the transcription tub to eliminate the wrinkles of the film, wherein said article supplying means includes means for directing the article to be printed upon from above said transcription tub downward and downstream into downward and downstream slanting contact with the film and transcription pattern thereon, changing the direction of movement of the article to be printed upon with the liquid and transferring the transcription pattern onto the article, and lifting the article slantingly upward and downstream to move the article and transcription pattern out of the transcription tub.

6. A printing apparatus as in claim 1, further comprising a set of two opposing belt type guide members disposed in said transcription tub so as to support both side edges of the film in said transcription tub and movable to feed the film in accordance with the flow rate of the liquid.

7. A printing apparatus in accordance with claim 6, wherein each of said two guide members is a chain belt.

8. A printing apparatus in accordance with claim 6, wherein each of said two guide members is a rubber belt.

9. A printing apparatus comprising (a) a transcription tub for containing a liquid, which is open at its upper side, (b) a means for directing a flow of the liquid through said transcription tub at a fixed rate, (c) a film supplying means, provided at an upstream side of said transcription tub relative to the flow direction of the liquid through said transcription tub, for supplying a transcription film onto the surface of the liquid so that a transcription pattern on the film is kept face up, (d) means, including a cutting mechanism, for notching in sequence both side edges of the film supplied by said film supplying means, and (e) an article supplying means, provided above said transcription tub, for immersing at least part of an article to be printed upon into the liquid while keeping the article in contact with the transcription pattern of the film, and for lifting up the article from the liquid.

10. A printing apparatus in accordance with claim 9, further comprising a film feed roller mechanism including a set of impression rollers, provided on said film supplying means, and said cutting mechanism includes a set of cutter rollers having cutters for notching both side edges of the film fitted to both ends of each roller of said set of cutter rollers, respectively.

11. A printing apparatus in accordance with claim 9, wherein said cutting mechanism is independently included in said film supplying means.

12. A printing apparatus comprising (a) a transcription tub for containing a liquid, open at its upper side, (b) a means for directing a flow of the liquid through said transcription tub at a fixed rate, (c) a film supplying means, provided at an upstream side of said transcription tub relative to the flow direction of the liquid in said transcription tub, and for supplying a transcription film onto the surface of the liquid so that a transcription pattern on the film is kept face up, (d) a film removing device provided next to said transcription tub and having a shower means for removing film waste from an article, and (e) an article supplying means, provided with an article carrying means, for carrying the article through said transcription tub and said film removing device, immersing at least part of the article from above the transcription tub into the liquid while keeping the article in contact with the transcription pattern of the film, and lifting up the article with the transcription pattern printed thereon from the liquid and carrying the article to said film removing device.

13. A printing apparatus in accordance with claim 12, wherein said film removing device includes a shower for dissolving and removing the film waste, a cleansing shower provided following said shower and an air blower for removing water provided following said cleansing shower.

14. A printing apparatus in accordance with claim 12, wherein said film removing device includes a drying device.

15. A printing apparatus in accordance with claim 14, wherein said drying device includes at least one hot air blowing pipe system which blows hot air onto the article.

16. A printing apparatus in accordance with claim 14, wherein a top coat applying device and a top coat drying device are adjacently located next to said drying device.

* * * * *